US008561334B2

(12) United States Patent
Metzger

(10) Patent No.: US 8,561,334 B2
(45) Date of Patent: Oct. 22, 2013

(54) MAGAZINE HOLDER

(75) Inventor: Thomas Metzger, Eckernförde (DE)

(73) Assignee: SIG Sauer GmbH, Eckernforde (DE)

( * ) Notice: Subject to any disclaimer, the term of this patent is extended or adjusted under 35 U.S.C. 154(b) by 71 days.

(21) Appl. No.: 12/968,380

(22) Filed: Dec. 15, 2010

(65) Prior Publication Data

US 2011/0146127 A1 Jun. 23, 2011

(30) Foreign Application Priority Data

Dec. 17, 2009 (EP) ..... 09179686

(51) Int. Cl.
*F41A 9/61* (2006.01)

(52) U.S. Cl.
USPC ..... 42/7; 42/49.01

(58) Field of Classification Search
USPC ..... 42/7, 49.01
See application file for complete search history.

(56) References Cited

U.S. PATENT DOCUMENTS

| | | | | | |
|---|---|---|---|---|---|
| 2,305,033 | A | * | 12/1942 | Roemer | 42/18 |
| 3,715,826 | A | * | 2/1973 | Seifried | 42/70.06 |
| 4,236,337 | A | | 12/1980 | Beretta | |
| 4,326,353 | A | * | 4/1982 | Ludwig et al. | 42/7 |
| 4,521,985 | A | * | 6/1985 | Smith et al. | 42/7 |
| 4,539,770 | A | * | 9/1985 | Bornancini | 42/7 |
| 4,574,509 | A | * | 3/1986 | Smith | 42/7 |
| 4,747,224 | A | * | 5/1988 | Smith | 42/7 |
| 4,768,301 | A | * | 9/1988 | Thomas | 42/7 |
| 4,798,018 | A | * | 1/1989 | Johansson | 42/7 |
| 4,835,892 | A | | 6/1989 | Ruger et al. | |
| 5,628,134 | A | * | 5/1997 | Wesp et al. | 42/7 |
| 7,559,166 | B2 | * | 7/2009 | Bubits | 42/7 |
| 8,037,805 | B1 | * | 10/2011 | Neroni | 89/196 |
| 8,166,691 | B1 | * | 5/2012 | Karfiol | 42/7 |
| 2007/0169390 | A1 | * | 7/2007 | Bubits | 42/7 |
| 2010/0281736 | A1 | * | 11/2010 | Mayberry et al. | 42/49.01 |
| 2010/0287806 | A1 | * | 11/2010 | Marfione et al. | 42/7 |
| 2012/0151814 | A1 | * | 6/2012 | Dietel | 42/84 |

FOREIGN PATENT DOCUMENTS

| | | | |
|---|---|---|---|
| DE | 2845121 | A1 | 4/1979 |
| DE | 2905770 | A1 | 8/1980 |
| DE | 10321993 | A1 | 12/2004 |
| EP | 0185087 | A1 | 6/1986 |
| EP | 0251721 | A1 | 1/1988 |
| FR | 2520496 | A1 | 7/1983 |

* cited by examiner

*Primary Examiner* — Michelle Clement
(74) *Attorney, Agent, or Firm* — Fleit Gibbons Gutman Bongini & Bianco PL; Martin Fleit; Paul D. Bianco

(57) ABSTRACT

The invention pertains to a magazine holder for detachably holding a cartridge magazine in a grip part of a handgun. The magazine holder features an actuating element that can be operated from both sides of the grip part and a spring element for resetting the actuating element into a center position. A simple and inexpensive manufacture and assembly of the magazine holder can be achieved if the spring element contains one or more locking elements for engaging into locking grooves of the cartridge magazine in an interlocking fashion.

10 Claims, 3 Drawing Sheets

MAGAZINE HOLDER

CROSS REFERENCE TO RELATED APPLICATIONS

This application claims priority under 35 U.S.C. §119 to European Patent Application No. 09179686 filed Dec. 17, 2009, the entire contents of which are incorporated herein by reference.

FIELD OF THE INVENTION

The invention pertains to a magazine holder for detachably holding a cartridge magazine in a grip part of a handgun.

BACKGROUND OF THE INVENTION

Previously known magazine holders for detachably holding a cartridge magazine in a grip part of a handgun usually feature an actuating element that can be operated from one or both sides and a locking mechanism that is acted upon by a spring element and makes it possible to fix the cartridge magazine within a magazine shaft or to release the cartridge magazine such that it can be exchanged. In known magazine holders, the spring elements merely serve for resetting the locking mechanism after the actuation. Separate holding elements are required for holding the cartridge magazine within the magazine shaft, wherein these holding elements usually require a complicated manufacture and assembly.

DE 29 05 770 C2 discloses a magazine holder for a pistol with a lever that can be pivoted about a transverse axis within the grip part. One lever arm is acted upon by a spring and features an extension in order to engage into a corresponding recess of the magazine. An actuating element that engages on the other lever arm makes it possible to pivot the lever against the force of the spring such that the extension on the lever arm is disengaged from the recess of the magazine in order to remove the magazine. The actuating element that can be operated from both sides of the pistol may consist of an adjusting bolt with conical adjusting surfaces that can be displaced transverse to the firing direction in the grip part against a spring force or of a web that is arranged in a recess transverse to the firing direction and can be pivoted forward with the aid of grip elements in order to unlock the magazine. Due to this design, the magazine holder can be actuated with the thumb of the firing hand by left-handed and right-handed persons. However, the magazine holder comprises a relatively large number of individual components that have complex shapes and cannot be easily manufactured.

SUMMARY OF THE INVENTION

The invention is based on the objective of developing a magazine holder of the initially cited type that can be operated from both sides of the handgun, as well as easily and inexpensively manufactured and assembled.

This objective is attained with a magazine holder with the characteristics described herein. Practical embodiments and advantageous additional refinements of the invention are also defined herein.

The inventive magazine holder features an actuating element that can be operated from both sides of the grip part and a spring element that not only serves for resetting the actuating element into a center position, but also features one or more locking elements for engaging into locking grooves of the cartridge magazine in an interlocking fashion. The spring element that acts as a return spring simultaneously fulfills the locking function for detachably holding the cartridge magazine in the grip part such that the number of required components is reduced and the manufacturing and assembly expenditures can be lowered.

In one particularly advantageous embodiment, the locking elements are realized in the form of locking edges on two bent retaining limbs of the spring element. Due to this measure, the cartridge magazine can be held in its functional position relative to the breech in a non-tilted and optimally aligned fashion.

The actuating element is advantageously arranged in a through-opening of the grip part in a transversely displaceable fashion and is detachably connected to operating elements that protrude from both sides of the grip part. The actuating element features openings through which the locking elements of the spring element can extend, wherein inner and outer edges are provided on said openings in order to move the retaining limbs into an unlocked position.

The magazine holder can be manufactured of two punched and bent components and a plastic part that can be used for both sides. This allows a simple and inexpensive manufacture.

BRIEF DESCRIPTION OF THE DRAWINGS

Other features and advantages of the invention are disclosed in the following description of preferred exemplary embodiments with the drawings. In these drawings.

DETAILED DESCRIPTION OF THE INVENTION

Figure 1:
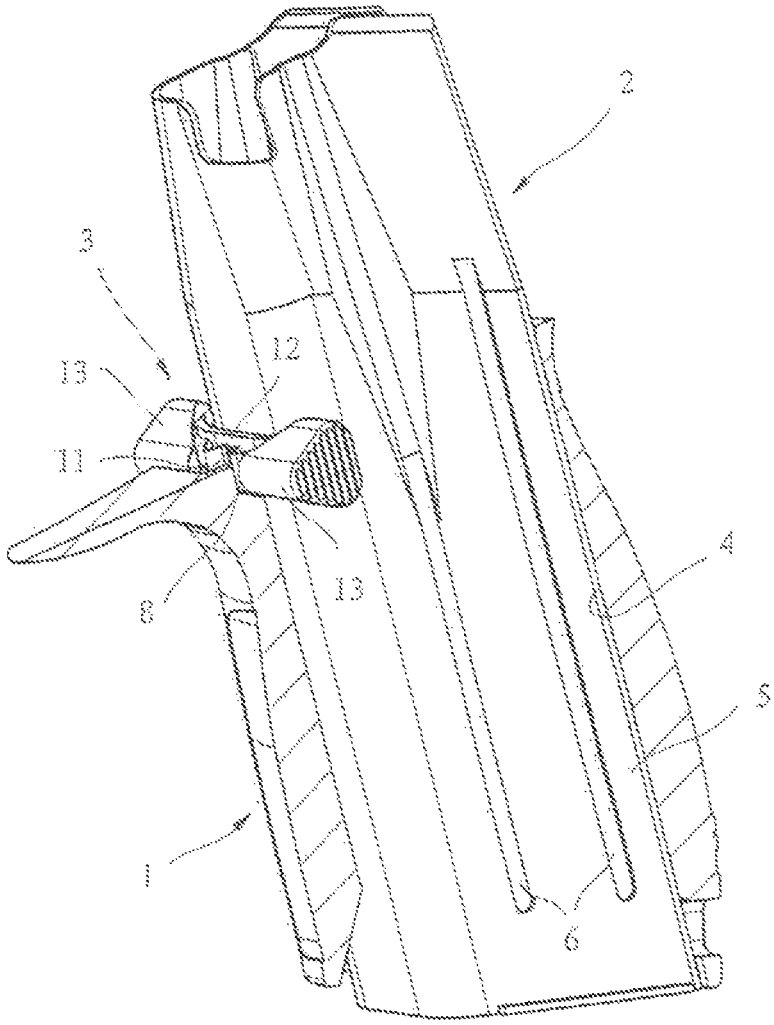
FIG. 1 shows a perspective representation of a section of a grip part with a cartridge magazine and an inventive magazine holder.

FIG. 1 shows a section of a grip part 1 of a pistol with a cartridge magazine 2 and a magazine holder 3 for detachably holding the cartridge magazine 2 in the grip part 1. The grip part 1, of which only a section is illustrated in the figure, defines a magazine shaft 4 that is accessible from the underside of the grip part 1 and into which the cartridge magazine 2 can be inserted. FIG. 1 also shows that lateral recesses 6 are arranged in the sidewalls of the magazine housing 5 of the cartridge magazine 2 in order to guide the cartridge magazine.

Figure 2:
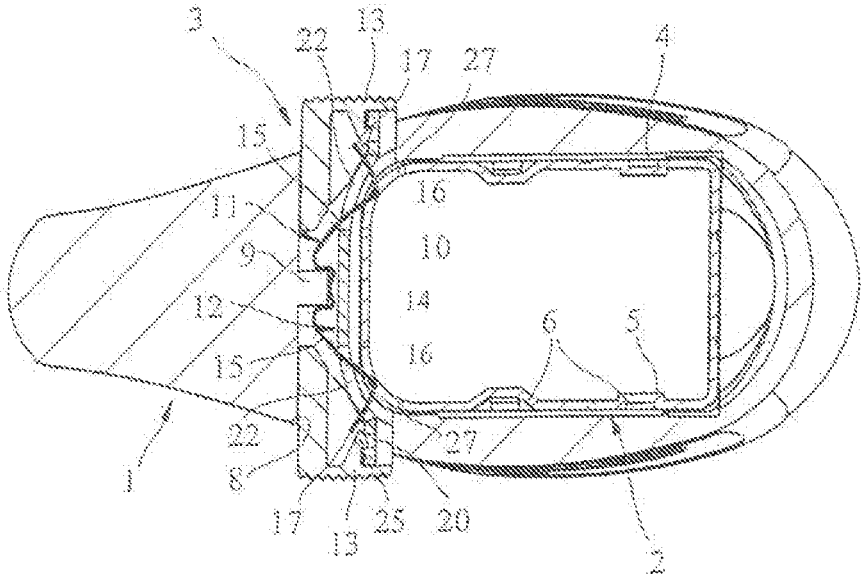
FIG. 2 shows a sectional representation of the magazine holder in a locked position.
Figure 3:
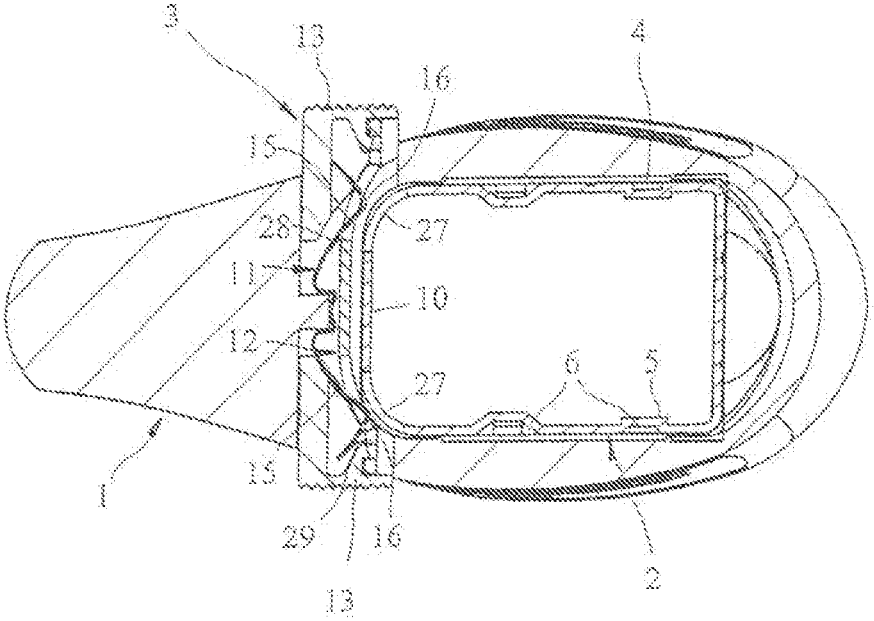
FIG. 3 shows a sectional representation of the magazine holder in an unlocked position.

FIGS. 2 and 3, in particular, show that the grip part 1 features a through-opening 8 on the front end of the magazine shaft 4 referred to the firing direction, wherein said through-opening transversely extends through the grip part 1 and accommodates the magazine holder 3. A retaining web 9 that protrudes inward and is integrally formed on the grip part 1 is provided in the interior of the through-opening 8, namely on the front inner side referred to the firing direction. The other inner side of the through-opening 8 is open toward the magazine shaft 4 such that the magazine housing 5 of the cartridge magazine 2 protrudes into the through-opening 8 with a front section 10.

The magazine holder 3 arranged in the through-opening 8 comprises a spring element 11 that is realized in the form of a magazine retaining spring and an actuating element 12 that can be displaced transverse to the grip part 1 by means of two operating elements 13 that protrude from both sides of the grip part. The two operating elements 13 are realized in the form of pushbuttons in this case and preferably consist of plastic while the spring element 11 and the actuating element 12 are realized in the form of punched and bent components of sheet steel or the like.

Figure 4A:
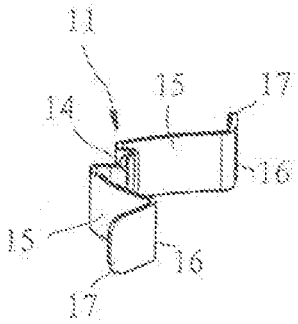
FIGS. 4*a*, 4*b* show two different views of the locking element of the magazine holder.
Figure 4B:
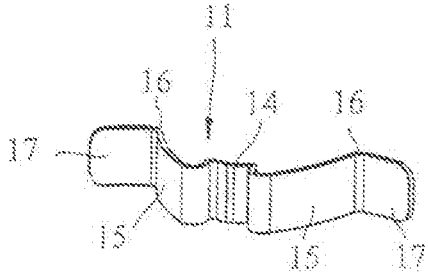

The spring element 11 is illustrated separately in FIGS. 4*a* and 4*b* and consists of a punched and bent component in the form of a leaf spring. It features a central retaining part 14 that is bent in a U-shaped fashion and two retaining limbs 15 that are bent outward in an L-shaped fashion, wherein said retaining limbs respectively feature a locking element 16 in the form of a locking edge and an angled end 17. The inside dimensions of the retaining part 14 are adapted to the retaining web 9 of the grip part 1 in such a way that the spring element 11 can be attached to the retaining web 9 and is held thereon under prestress.

Figure 5A:
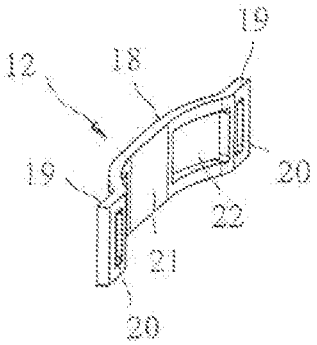
FIGS. 5*a*, 5*b* show two different views of a magazine holder slide of the magazine holder.
Figure 5B:
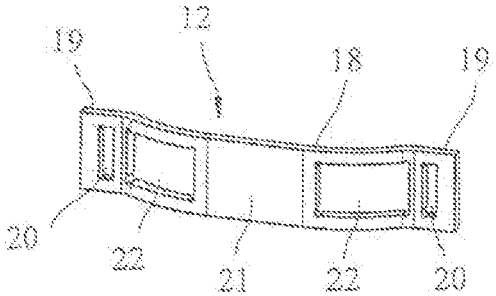

FIGS. 5*a* and 5*b* show the actuating element 12 that is also realized in the form of a punched and bent component and is manufactured of a rectangular sheet metal section. The actuating element 12 that can be displaced transverse to the grip part 1 contains a bent inner part 18 and two end webs 19, in which rectangular openings 20 are provided for connecting the actuating element 12 to the operating element 13. A rectangular opening 22 is respectively arranged in the bent inner part 18 to both sides of a closed center part 21, wherein the locking elements 16 of the two retaining limbs 15 of the spring element 11, which are realized in the form of locking edges, can extend through these rectangular openings.

Figure 6A:
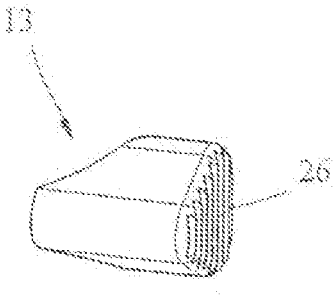
FIGS. 6*a*, 6*b* show two different views of a pushbutton of the magazine holder.
Figure 6B:
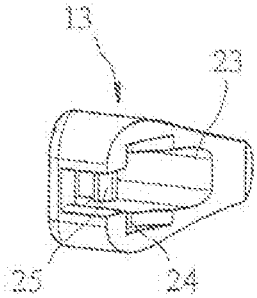

The inner side of the operating element 13 illustrated in FIGS. 6*a* and 6*b* contains a depression 23 with a slot 24 for accommodating the end web 19 of the actuating element 12. In addition, a locking tab 25 for engaging into the opening 20 of the actuating element 12 in an interlocking fashion is arranged in the depression 23. A ribbing 26 is provided on the outer side of the operating element 13 in the form of a pushbutton. The operating element 13 is preferably manufactured of plastic and can be used for the right and the left side of the grip part 1. The locking tab 25 makes it possible to connect the two operating elements 13 to the actuating element 12 by means of a clip connection of sorts such that a simple installation and removal of the magazine holder on/from the grip part 1 is achieved.

The function of the above-described magazine holder is described below with reference to the locked position illustrated in FIG. 2 and the unlocked position illustrated in FIG. 3.

In the locked position illustrated in FIG. 2, the locking elements 16 of the two retaining limbs 15 of the spring element 11, which are realized in the form of locking edges, protrude into locking grooves 27 on the front side 10 of the magazine housing 5 through the openings 22 of the actuating element 12 such that the cartridge magazine 2 is held in its functional position in the magazine shaft 4. The actuating element 12 realized in the form of a slide is held in the center position shown by means of the spring element 11 that is fixed in the grip part 1 with the aid of the central retaining part 14. The two operating elements 13 are rigidly connected to the actuating element 12 by means of the retaining tabs 25 engaging into the openings 20. The operating elements 13 are displaceably guided in the through-opening 8 of the grip part 1 and can be displaced transverse to the grip part 1 against the force of the spring element 11.

When the actuating element 12 is displaced by depressing the right or left operating element 13 against the prestress of the spring element 11, the two retaining limbs 15 are pressed forward referred to the firing direction by the actuating element 12 such that the locking elements 16 in the form of locking edges are disengaged from the locking grooves 27 and the cartridge magazine 2 is released and can be removed. For example, when the operating element 13 that is illustrated on the bottom in FIG. 3 and is arranged on the left side of the grip part is depressed, the upper retaining limb 15 is pressed forward by the inner edge 28 of the upper opening 22 in the actuating element 12 while the lower retaining limb 15 is pushed forward by the outer edge 29 of the lower opening 22 in the actuating element 12. The retaining limbs 15 are also correspondingly displaced when the other operating element 13 is actuated.

When the operating element 13 is released again, the prestressed spring element 11 returns the actuating element 12 into its center position. Consequently, a newly inserted cartridge magazine 2 can be once again automatically interlocked because the retaining limbs 15 of the spring element 11 are pressed down by the magazine housing 5 of the cartridge magazine 2 inserted into the magazine shaft 4 and automatically engage into the locking grooves 27 of the magazine housing 5 due to their spring tension.

The invention claimed is:

1. A magazine holder for detachably holding a cartridge magazine in a grip part of a handgun, the magazine holder comprising:

an actuating element operable from right and left sides of the grip part without detachment, the actuating element traversely displaceable to the grip part; and a spring element configured to reset the actuating element in a center position, the spring element including one or more locking elements configured to engage locking grooves of the cartridge magazine.

2. The magazine holder according to claim 1, wherein the locking elements are formed as locking edges on two bent retaining limbs of the spring element.

3. The magazine holder according to claim 1, wherein the actuating element further comprises openings, through which the locking elements of the spring element extend.

4. The magazine holder according to claim 3, wherein the openings include inner and outer edges configured for moving retaining limbs of the spring element into an unlocked position to release the cartridge magazine.

5. The magazine holder according to claim 1, wherein the actuating element is detachably connected to two operating elements, one of the two operating elements protruding from the right side of the grip part and the other of the two operating elements protruding from the left side of the grip part.

6. The magazine holder according to claim 5, wherein the operating elements are detachably connected to the actuating element by locking tabs, the locking tabs configured to engage openings in the actuating element.

7. The magazine holder according to claim 1, wherein the spring element further comprises a central retaining part configured for fixing on a retaining web of the grip part.

8. The magazine holder according to claim 1, further comprising two operating elements, one of the two operating elements protruding from the right side of the grip part and the other of the two operating elements protruding from the left side of the grip part, wherein an inner side of each operating element includes a depression with a slot configured to accommodate an end web of the actuating element.

9. The magazine holder according to claim 1, wherein the spring element and the actuating element comprise both punched and bent components.

10. The magazine holder according to claim 1, further comprising an operating element manufactured of plastic.

* * * * *